US005783530A

United States Patent [19]

Foster et al.

[11] Patent Number: 5,783,530

[45] Date of Patent: Jul. 21, 1998

[54] NON-STAINING SOLID LUBRICANTS

[75] Inventors: Mark Howard Foster; Christopher Pargeter, both of Banbury, Great Britain

[73] Assignee: Alcan International Limited, Quebec, Canada

[21] Appl. No.: 203,879

[22] Filed: Mar. 1, 1994

Related U.S. Application Data

[63] Continuation of Ser. No. 847,104, Jun. 15, 1992, abandoned.

[30] Foreign Application Priority Data

Oct. 31, 1989 [GB] United Kingdom ..... 8924457

[51] Int. Cl.[6] ..... C10M 129/68; C10M 129/06

[52] U.S. Cl. ..... 508/505; 508/583; 508/591; 72/42

[58] Field of Search ..... 252/52 R, 56 R; 508/505, 583, 591; 72/42

[56] References Cited

U.S. PATENT DOCUMENTS

| | | | |
|---|---|---|---|
| 2,031,930 | 2/1936 | Buc | 252/52 R |
| 2,899,390 | 8/1959 | Plemich et al. | 508/591 |
| 2,962,401 | 11/1960 | Guminski | 252/52 R |
| 3,298,951 | 1/1967 | Guminski | 252/52 R |
| 3,505,844 | 4/1970 | McLean | 252/52 R |
| 3,765,955 | 10/1973 | Kushima | 148/31.5 |
| 3,770,636 | 11/1973 | McDole et al. | 508/583 |
| 3,855,136 | 12/1974 | McDole et al. | 252/52 R |
| 3,899,433 | 8/1975 | Unick | 252/52 R |
| 4,687,587 | 8/1987 | Daglish et al. | 508/591 |
| 4,844,830 | 7/1989 | Budd et al. | 252/52 R |

FOREIGN PATENT DOCUMENTS 0192329 6/1986 European Pat. Off. .

OTHER PUBLICATIONS

PCT Int'l Search Report for Application No. PCT/GB90/01659.

*Primary Examiner*—Margaret Medley
*Attorney, Agent, or Firm*—Cooper & Dunham LLP

[57] ABSTRACT

As a lubricant for cold-working of metal there is provided on the surface of the metal to be subjected to working a solid film of a saturated aliphatic monohydric alcohol having 14 to 18 carbon atoms. After the metal has been worked, the solid lubricant may be removed by heating without causing staining of the metal surface. The solid lubricant film may additionally contain from 1 to 10% by weight of a polybutene, petroleum jelly or butyl stearate to modify the properties of the lubricant film.

11 Claims, No Drawings

NON-STAINING SOLID LUBRICANTS

This is a continuation of application Ser. No. 847,104, filed Jun. 15, 1992, now abandoned.

The present invention relates to non-staining solid lubricants suitable for use in metal working operations, for instance in cold-rolling, drawing or extrusion of metals, especially aluminium.

Lubricants, usually liquid lubricants, are used in metal working operations to reduce friction between the surface of metal being worked and a surface of the apparatus carrying out the operation. A liquid lubricant reduces friction by separating the two surfaces with a thin fluid film having little resistance to shear. In many metal working operations the pressure between a surf ace of the metal being worked and a surf ace of the apparatus is so great that the fluid film of a liquid lubricant may be squeezed out so allowing actual metal-to-metal contact with the result that excessive damage to the surfaces may occur. Solid film lubricants having much greater load bearing properties have been developed to overcome this and other disadvantages associated with liquid lubricants.

In addition to its lubrication characteristics, a lubricant may be expected to fulfill certain other requirements if it is to be useful industrially. For instance, it should be easy to apply and easy to remove, it should afford some protection to the metal surface during handling and storage, it should present no health hazard to persons coming into contact with it and, obviously, should be inert to the surfaces with which it comes into contact. Many lubricants produce severe stains on the surface of the metal during annealing thereof. It is, therefore, highly desirable to avoid such staining by using a lubricant having the properties demanded by the particular conditions under which the lubricated metal is to be worked and which is also non-staining.

The present invention is based on the discovery that a solid film of one or more saturated aliphatic monohydric alcohols having from 14 to 18 carbon atoms provided on the surface of the metal being worked has good lubrication characteristics under cold-working conditions and can be removed by heating to leave substantially no stain on the metal surface.

The present invention provides the use, in the cold working of a metal workpiece, as a lubricant in the form of a solid film on the surface of the metal workpiece of a saturated aliphatic monohydric alcohol having from 14 to 18 carbon atoms.

The present invention also provides the use, in the cold-working of a metal workpiece, of a composition capable of forming a solid deposit of lubricant on the surface of the metal workpiece when applied thereto which composition comprises a solution of a saturated aliphatic monohydric alcohol having from, 14 to 18 carbon atoms in an inert volatile organic solvent.

According to the invention, use is made of a saturated aliphatic monohydric alcohol having from 14 to 18 carbon atoms. Such alcohols have good lubricating and load-supporting properties, are solid at room temperatures (20°–25° C.) and may be, at worst, only slightly staining or, at best, totally non-staining. Examples of these alcohols included myristyl alcohol, cetyl alcohol and stearyl alcohol. Commercial purity compounds may be used and these generally contain proportions of higher and/or lower homologues as impurities. Cetyl alcohol (hexadecanol) is highly preferred for use in the present invention in view of its melting point (a/49° C.) and because of its excellent non-staining property.

Typically, the 14–18C saturated aliphatic monohydric alcohol lubricant is applied to the surface of the metal workpiece by dip coating the workpiece in a solution of the alcohol lubricant in an inert volgatile organic solvent. After removal of the volatile solvent by evaporation a film of the solid alcohol remains on the surface of the workpiece. It is possible that the film obtained in this way may not be of uniform thickness; the deposited alcohol lubricant being thicker in some regions than in other regions of the surface of the workpiece. We have observed, however, that in such cases where the thickness of the deposited film of solid alcohol is non-uniform the film flows at the point where pressure is applied to the workpiece during working thereof, e.g. at the die in a metal drawing operation or at the press platen in a metal pressing operation, with the result that the workpiece becomes evenly covered at the point of working.

To form the lubricant coating composition, the 14–18C saturated aliphatic monohydric alcohol is dissolved in an inert volatile organic solvent Generally, any organic solvent for the alcohol which is liquid at normal room temperature but which evaporates at a temperature just above that and which is inert to both the alcohol and the metal surface may be used. Examples of suitable solvents include diethyl ether, methanol and benzene and chlorinated hydrocarbons, such as trichloroethylene and 1,1,1-trichloroethane. The concentration of the 14–18C. alcohol in the volatile organic solvent is not critical and, in principle, any concentration up to the solubility limit of the particular solvent may be used. Typically, the concentration of alcohol in the organic solvent will be about 10% by weight.

According to the present invention, it is possible to incorporate certain amounts of other substances in the lubricating film of 14–18C saturated aliphatic monohydric alcohol in order to modify the properties of the film. For instance, a liquid polybutene may be incorporated in an amount of up to 10% by weight of the total weight of the lubricant composition (excluding solvent) to modify the film properties of the lubricant on the surface of the workpiece and the flow characteristics of the lubricant film during the deformation without causing staining of the metal surface on annealing. The use of the liquid polybutene tends to soften any film containing it and the 14–18 saturated aliphatic monohydric alcohol and, therefore, if more than 10% by weight of the liquid polybutene is used the lubricant film obtained on the surface of the workpiece may become tacky and rather unstable. Any liquid polybutene may be used according to this embodiment of the invention. Liquid polybutene are available commercially under the name Hyvis ("Hyvis" is a registered trademark), for example Hyvis 200 having a molecular mass (number average) of 2400 and a Kinematic viscosity of 4300 eSt at 98.9*° C.

The non-staining solid lubricant according to the present invention may contain a small amount of a solid or semi-liquid (e.g. gelatinous) alkane species or mixture of alkane species which does not leave a staining residue on annealing, for example petroleum jelly (petrolatum), to modify the film properties of the lubricant. Such an alkane-based film modifier may be used together with or as an alternative to the liquid polybutene mentioned above. Generally, any alkane-based film modifier if used will be used in an amount such that the combined weight of alkane-based film modifier and any liquid polybutene does not represent more than 10% of the weight of the total lubricant composition (excluding solvent). We have further found that the incorporation of an (liquid) ester, e.g. butyl stearate, methyl laurate or methyl myristate, in the 14–18C saturated aliphatic monohydric alcohol lubricant film tends to aid the production of a uniform film and also tends to soften the film. This tendency to soften the film is an additional advantage in the case where the lubricant also contains a polybutene additive since it makes it easier for the polybutene-containing lubricant to be removed from surfaces (including hands). If used, the ester may be used in an amount not exceeding 10% by weight based on the total weight of the lubricant (excluding solvent) and would be incorporated as an alternative to an equivalent amount of liquid polybutene. We refer, however, not to use more than about 1% by weight of the ester.

The solid lubricant, after evaporation of the volatile carrier solvent, forms a tenacious film on the surface of a metal workpiece. A typical lubricant coverage would be less than about 10 $gm^{-2}$. Preferably, however, the lubricant solution will be applied to a metal surface to provide about 5g of solid lubricant per square meter of surface.

After deformation etc. of the workpiece the solid film lubricant does not require removal prior to annealing the metal since the component(s) of the solid lubricant, i.e. the alcohol and any optionally present polybutene, petroleum jelly and/or butyl stearate, will evaporate from or decompose on the metal surface cleanly without staining.

EXAMPLES

Example 1

An aluminum tube was dipped in a 10% w/w solution of cetyl alcohol in trichloroethylene and then allowed to dry. The coated tube was passed four times through a drawing machine. After each pass, the tube was annealed by heating to 400° C., with no prior degreasing and no staining and then re-dipped in the cetyl alcohol solution. The following Table 1 shows the outside and inside diameters of the tube, the percentage reduction in the cross sectional area, and the length of the tube after each pass. The reductions are set by the size of the die used, which is why they are variable. However, the final reduction of 23% is excellent and the tube after the final pass showed no surface staining.

TABLE 1

| | Outside diameter (mm) | Inside diameter (mm) | % Reduction | Length (m) |
|---|---|---|---|---|
| Initial dimensions of tube | 293.0 | 275.4 | — | 3 |
| After 1st pass | 287.3 | 272.6 | 21 | 3.6 |
| After 2nd pass | 283 | 269.9 | 12.4 | 4.2 |
| After 3rd pass | 278 | 267.2 | 19 | 5.2 |
| After 4th pass | 273.8 | 265.4 | 23 | 6.8 |

Example 2

A series of disc compression tests was carried out using various lubricants. In each case, an aluminium disc having a diameter of 32 mm and a thickness of 5 mm was dipped into a solution of the lubricant under test in a Volatile organic solvent so that both the upper and the lower surfaces of the disc were coated with the lubricant solution. The coated disc was then left until the organic solvent had evaporated to leave a coating of lubricant on the aluminium surface. Each disc was subjected to pressing at $5.6\times10^7$ kg $m^{-2}$ over a period of 30 seconds and the thickness of the disc was then measured. The test was carried out 5 times for each lubricant and the mean reduction (%) was calculated. Each lubricated disc was annealed at 400° C. and checked for any staining. The results are shown below in Table 2.

TABLE 2

| Lubricant | Reduction (%) Mean | Reduction (%) Std. deviation | Staining of Metal Surface on annealing (400° C.) |
|---|---|---|---|
| *'Batoyl' | 49.9 | 0.77 | heavy dark stain |
| *'Silkolene' | 48.4 | 0.33 | heavy dark stain |
| 100% cetyl alcohol | 56.7 | 0.55 | none |
| 90% cetyl alcohol 10% petroleum jelly | 60.9 | 0.61 | none |
| 75% cetyl alcohol 25% petroleum jelly | 59.5 | 0.62 | none |

*'Batoyl' and 'Silkolene' are proprietory solid film lubricants based on a heavy oil containing extreme pressure additives.

We claim:

1. A method of cold forming a metal workpiece consisting essentially of:

providing on the surface of the metal workpiece a solid film of a lubricant consisting essentially of cetyl alcohol and petroleum jelly, wherein the petroleum jelly is present in an amount not greater than 25% by weight based on the weight of the solid film, the solid film being provided on the metal surface by applying thereto a solution of cetyl alcohol and petroleum jelly in an inert volatile organic solvent and evaporating the inert volatile organic solvent;

subjecting the workpiece to a cold forming operation; and removing the solid film of lubricant from the surface of the metal workpiece by the application of heat, wherein the solid film is removed without staining the metal surface.

2. A method according to claim 1, wherein the petroleum jelly is present in the solid lubricant film in an amount of not greater than 10% by weight based on the weight of the solid film.

3. A method according to claim 1, wherein the inert volatile organic solvent is trichloroethylene or 1, 1, 1-trichioroethane.

4. A method according to claim 1, wherein the solid film of lubricant provided on the surface of the metal workpiece also contains liquid polybutene, butyl stearate, methyl laurate or methyl myristate as a film modifier and wherein the total of the amount of film modifier and the amount of petroleum jelly does not exceed 10% by weight of the lubricant.

5. A method according to claim 4, wherein the solid film of lubricant contains butyl stearate, the butyl stearate being present in an amount not greater than 1% by weight based on the total weight of the solid lubricant film.

6. A method according to claim 4, wherein the solid film of lubricant contains liquid polybutene having a molecular mass (number average) of 2400 and a kinematic viscosity of 4300 centistokes at 98.9° C.

7. A method according to claim 4, wherein the solution of cetyl alcohol and petroleum jelly in the inert volatile organic solvent contains about 10% by weight of cetyl alcohol.

8. A method according to claim 1, wherein the metal workpiece is formed of aluminum or aluminum alloy.

9. A method according to claim 1, wherein the metal workpiece is in the form of a tube and is subjected to a cold drawing operation.

10. A method according to claim 1, wherein the solution of cetyl alcohol and petroleum jelly in an inert volatile organic solvent is applied to the surface of the metal workpiece to provide, after evaporation of the inert volatile organic solvent, a solid film of cetyl alcohol and petroleum jelly on the surface of the metal workpiece in an amount of less than about 10 g per square meter of surface.

11. A method according to claim 10, wherein the solution of cetyl alcohol and petroleum jelly in an inert volatile organic solvent is applied to the surface of the metal workpiece to provide, after evaporation of the inert volatile organic solvent, about 5 g of a solid film of cetyl alcohol and petroleum jelly per square meter of surface.

* * * * *